US005469587A

United States Patent [19]

Demeny

[11] Patent Number: 5,469,587

[45] Date of Patent: Nov. 28, 1995

[54] PORTABLE EMERGENCY DECONTAMINATION SHOWER

[75] Inventor: Rodney L. Demeny, Medinah, Ill.

[73] Assignee: Fendall Company, Arlington Heights, Ill.

[21] Appl. No.: 359,573

[22] Filed: Dec. 20, 1994

[51] Int. Cl.[6] ..... A47K 3/23

[52] U.S. Cl. ..... 4/599; 4/615; 4/900; 239/279

[58] Field of Search ..... 4/599, 600, 602, 4/603, 615, 900, 596, 612; 239/279, 280

[56] References Cited

U.S. PATENT DOCUMENTS

| | | | |
|---|---|---|---|
| 2,247,340 | 6/1941 | Webster . | |
| 2,665,171 | 1/1954 | Stievater | 239/280 |
| 2,841,832 | 7/1958 | Couse et al. . | |
| 2,875,771 | 3/1959 | Brewin . | |
| 3,208,083 | 9/1965 | Witczak | 4/615 X |
| 3,345,996 | 10/1967 | Sadove et al. . | |
| 3,391,409 | 7/1968 | Gatley . | |
| 3,439,966 | 4/1969 | Perkins et al. . | |
| 3,501,213 | 3/1970 | Trexler . | |
| 3,629,875 | 12/1971 | Dow . | |
| 3,925,828 | 12/1975 | Kim . | |
| 3,955,328 | 5/1976 | Lindsay . | |
| 4,171,595 | 10/1979 | Tucker . | |
| 4,197,681 | 4/1980 | Holcombe . | |
| 4,348,777 | 9/1982 | Peterson . | |
| 4,675,923 | 6/1987 | Ashley . | |
| 4,777,675 | 10/1988 | Letner . | |
| 4,800,597 | 1/1989 | Healey . | |
| 5,007,212 | 4/1991 | Fritts et al. . | |
| 5,216,763 | 6/1993 | Grenier | 4/900 X |
| 5,311,620 | 5/1994 | Ratje . | |

FOREIGN PATENT DOCUMENTS

| | | |
|---|---|---|
| 273870 | 6/1988 | European Pat. Off. . |
| 1523414 | 5/1968 | France . |
| 2415906 | 10/1975 | Germany . |
| 2449119 | 4/1976 | Germany . |
| 3612129 | 10/1987 | Germany . |
| 511129 | 3/1959 | Italy . |
| 850512 | 10/1960 | United Kingdom . |
| 1142946 | 2/1969 | United Kingdom . |
| 2179549 | 3/1987 | United Kingdom . |

OTHER PUBLICATIONS

Catalog sheet for "Decon Shower System".

Catalog sheet for "Collapsible Decontamination Booth", Lab Safety Supply, p. 485.

Catalog sheet for "Encon® Walk–Through Shower", Lab Safety Supply, p. 359.

Catalog sheet for "Hydro Kube™ Portable Shower Module", Occupational Health & Safety, p. 34.

Catalog sheet for "Dispos–A–Con™ Haz–Mat Emergency Response Shower", AR Manufacturing & Sales, Inc., Oklahoma City, Okla.

Catalog sheet for "Hazmat Decon Shower", RMC Medical, Philadelphia, Pa.

Catalog sheet for "Portaflex 300 Portable, Lightweight, Multi–Purpose Decontamination Shower", Hughes Safety Showers, England.

*Primary Examiner*—Charles E. Phillips

*Attorney, Agent, or Firm*—Arnold, White & Durkee

[57] ABSTRACT

A portable shower comprises an upper polygon section, a base polygon section, a plurality of hollow supporting posts, and an inlet manifold. Each of the polygon sections includes a plurality of rigid hollow joints connected by flexible hoses. Each of the supporting posts includes at least one rigid pipe, and the supporting posts connect the joints of the base polygon section to the corresponding joints of the upper polygon section. A plurality of spray nozzles are mounted to the supporting posts. An output of the inlet manifold is preferably connected to one of the supporting posts, and an input of the inlet manifold is preferably connected to a water source. With a valve along the inlet manifold opened, turning on the water source causes water from the water source to flow into the upper polygon section, the base polygon section, and the supporting posts via the inlet manifold. The water exits the supporting posts via the spray nozzles.

18 Claims, 6 Drawing Sheets

PORTABLE EMERGENCY DECONTAMINATION SHOWER

FIELD OF THE INVENTION

The present invention generally relates to emergency decontamination showers. More particularly, the present invention relates to a portable emergency decontamination shower which may be quickly deployed at an emergency decontamination site.

BACKGROUND OF THE INVENTION

During emergency and hazardous materials response, a response team typically arrives at a decontamination site in a response vehicle and then attends to a chemical spill at the site. The responders are often dressed in full chemical gear with self-contained breathing apparatus. After attending to the chemical spill, the responders must decontaminate themselves prior to removing their chemical gear. In addition, victims of the chemical spill should be provided with emergency chemical decontamination.

SUMMARY OF THE INVENTION

The safety of emergency responders is an important factor in emergency and hazardous materials response. The portable shower of the present invention is designed to provide decontamination facilities on site without distracting emergency responders from their primary task of cleaning up a chemical spill. With this portable shower, emergency response teams can have emergency decontamination facilities within minutes of arriving on site. The unique design of the portable shower allows the shower to be quickly deployed on site; the shower is fully operational within seconds of connecting the shower to a water source and turning on the water source.

In one particular embodiment of the present invention, the portable shower includes an upper polygon section, a base polygon section, a plurality of hollow supporting posts, and an inlet manifold. Each of the polygon sections includes a plurality of rigid hollow joints, i.e., corner fittings, connected by flexible hoses. Each of the supporting posts includes at least one rigid pipe, and the supporting posts connect the joints of the base polygon section to the corresponding joints of the upper polygon section. A plurality of spray nozzles are mounted to the supporting posts. An output of the inlet manifold is preferably connected to one of the supporting posts, and an input of the inlet manifold is preferably connected to a water source. With a valve along the inlet manifold opened, turning on the water source causes water from the water source to flow into the upper polygon section, the base polygon section, and the supporting posts via the inlet manifold. The water exits the supporting posts via the spray nozzles.

BRIEF DESCRIPTION OF THE DRAWINGS

Other objects and advantages of the present invention will become apparent upon reading the following detailed description and upon reference to the accompanying drawings, in which.

Figure 1:
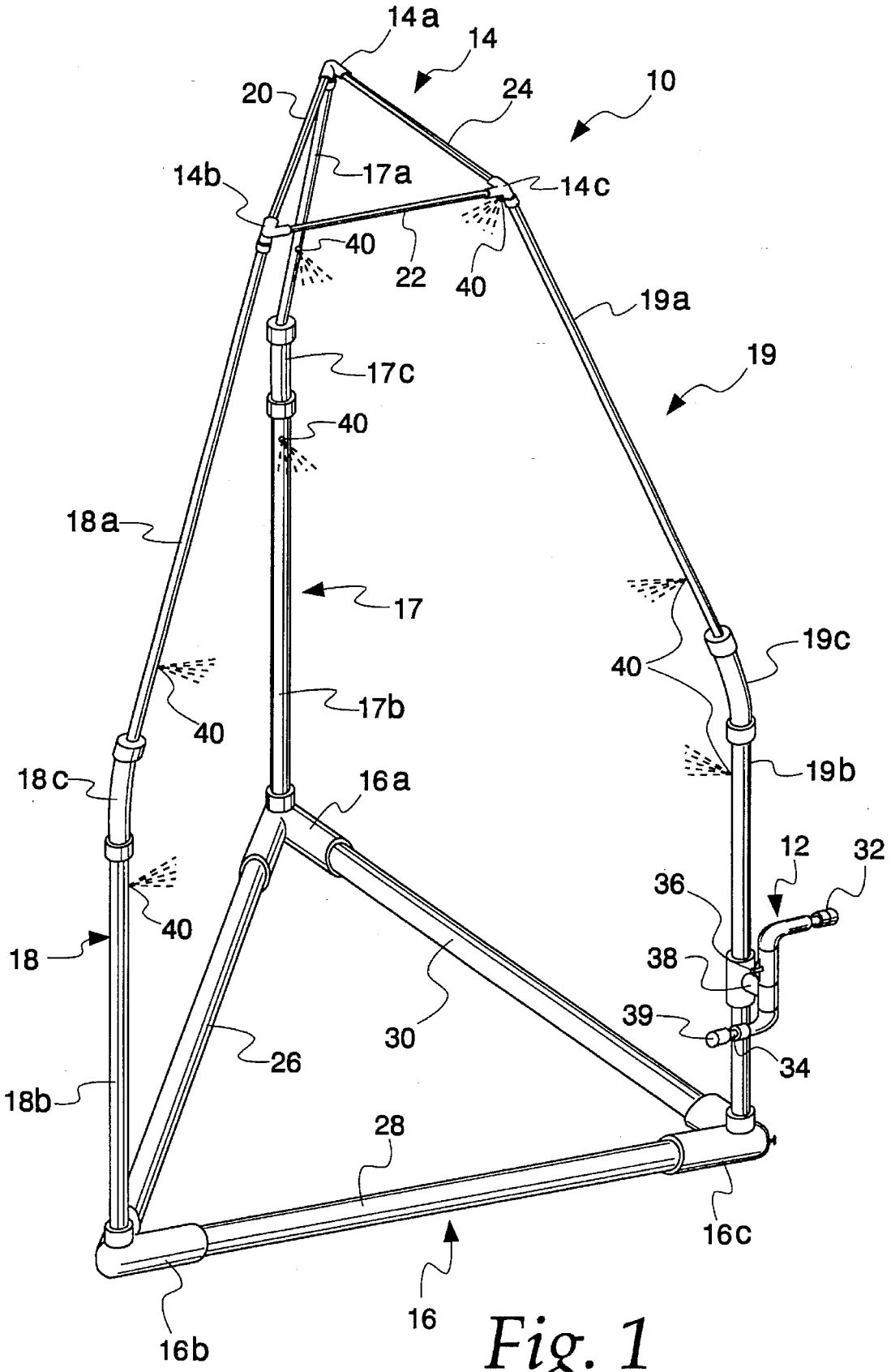
FIG. 1 is a perspective view of an emergency decontamination shower embodying the present invention, showing the shower in fully expanded form.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 7:
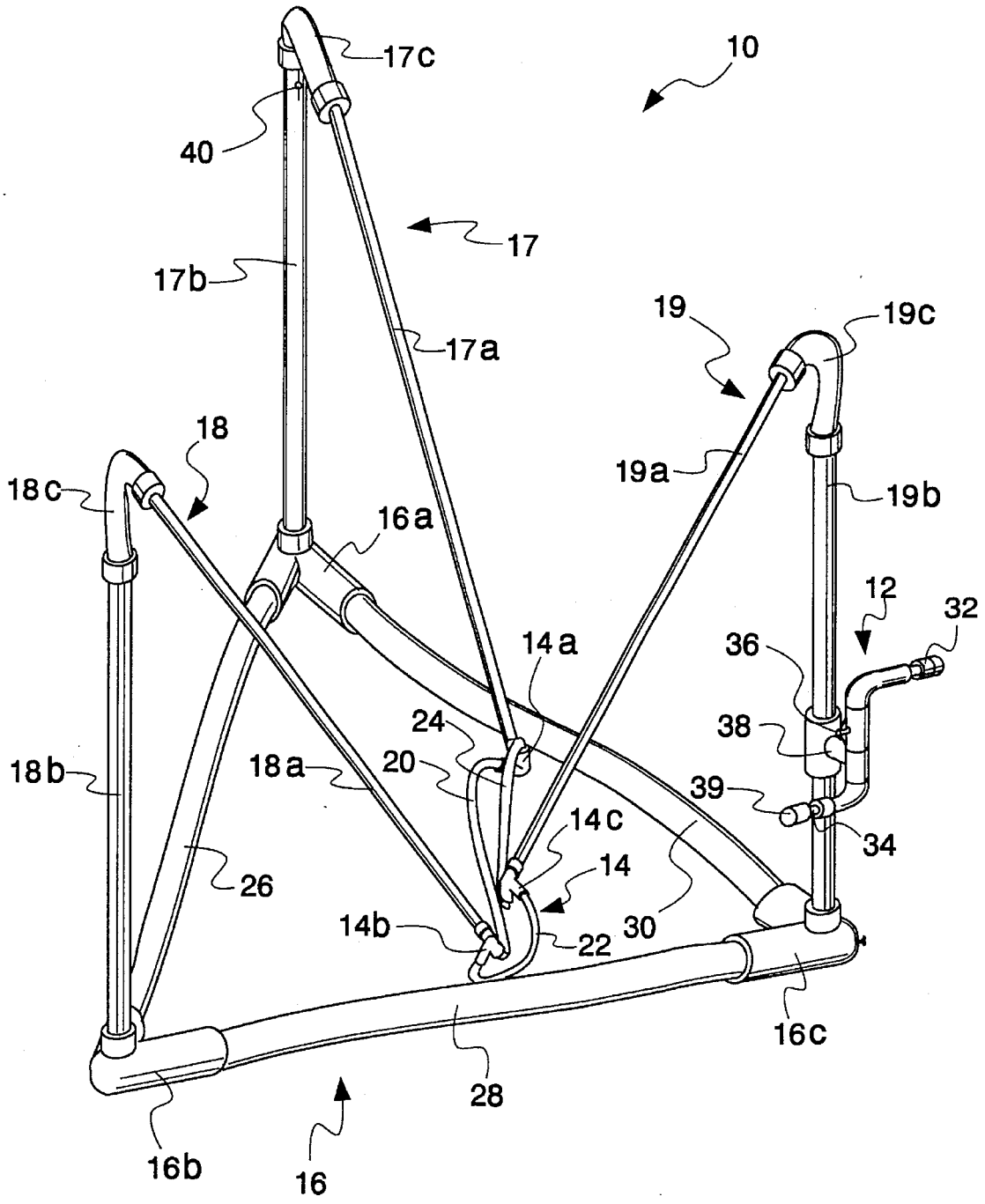
FIG. 7 is a perspective view of the emergency decontamination shower embodying the present invention, showing the shower in compact form.

Turning now to the drawings, FIG. 1 illustrates an emergency decontamination shower 10 in expanded form after turning on a water supply in fluid communication with an inlet manifold 12. FIG. 7 depicts the shower 10 in compact form prior to turning on the water supply. In addition to the inlet manifold 12, the shower 10 includes an upper triangle section 14, a base triangle section 16, and three supporting posts 17, 18, and 19.

Figure 4:
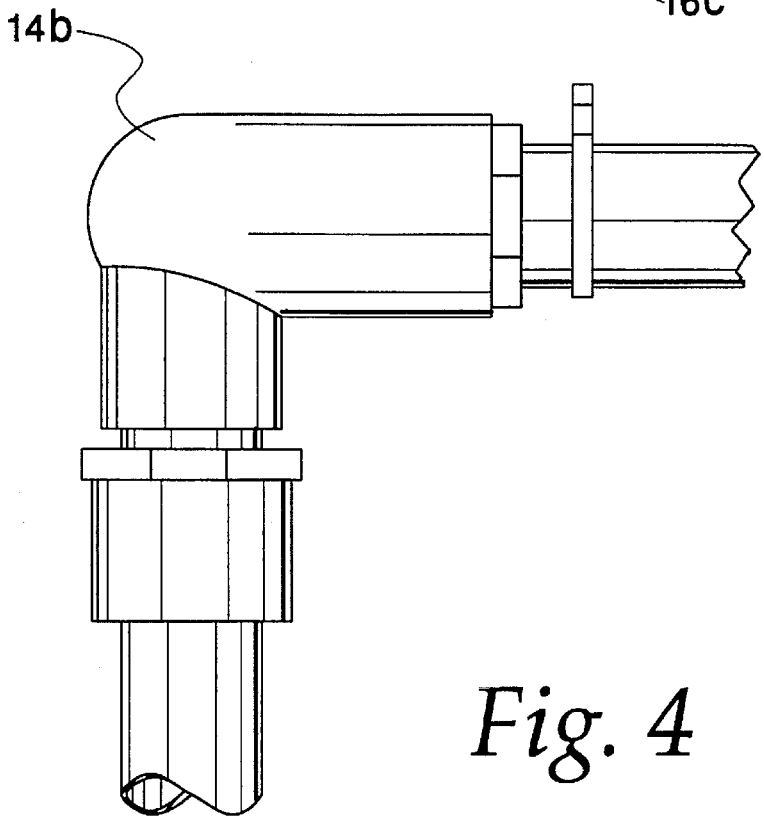
FIG. 4 is an enlarged side view of an upper joint of the emergency decontamination shower in FIG. 1.

The upper triangle section 14 is formed from identical rigid, hollow three-port joints 14*a*, 14*b*, and 14*c* and identical flexible hoses 20, 22, and 24. FIG. 4 is an enlarged side view of the joint 14*b*. Referring back to FIG. 1, the joint 14*a* connects the hose 20 to the hose 24, the joint 14*b* connects the hose 20 to the hose 22, and the joint 14*c* connects the hose 22 to the hose 24. Since the joints 14*a*, 14*b*, and 14*c* are identical to each other and the hoses 20, 22, and 24 are identical to each other, the upper triangle section 14 forms an equilateral triangle. In the preferred embodiment, each side of this equilateral triangle measures approximately 17 inches in length.

Figure 3:
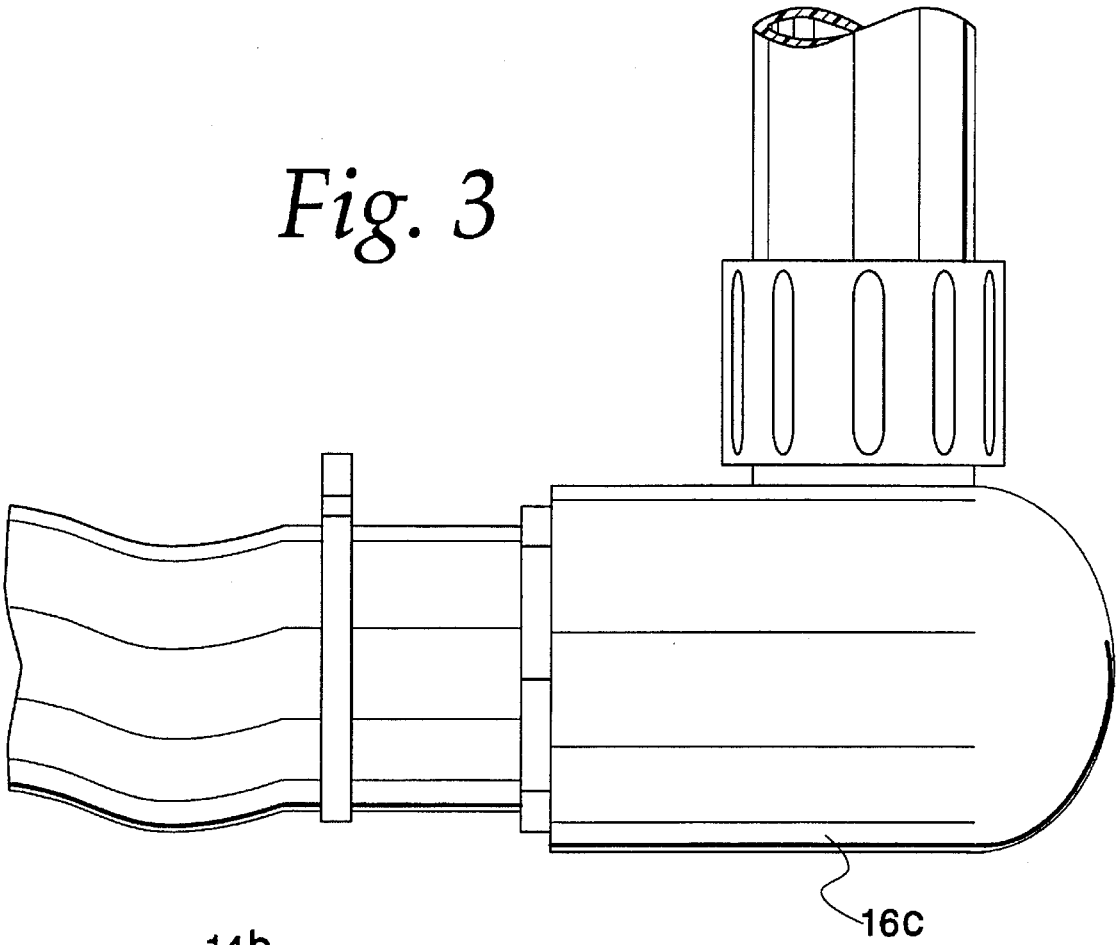
FIG. 3 is an enlarged side view of a lower joint of the emergency decontamination shower in FIG. 1.

The base triangle section 16 is formed from identical rigid three-port joints 16*a*, 16*b*, and 16*c* and identical flexible hoses 26, 28, and 30. FIG. 3 is an enlarged side view of the joint 16*c*. Referring back to FIG. 1, the joint 16*a* connects the hose 26 to the hose 30, the joint 16*b* connects the hose 26 to the hose 28, and the joint 16*c* connects the hose 28 to the hose 30. Since the joints 16*a*, 16*b*, and 16*c* are identical to each other and the hoses 26, 28, and 30 are identical to each other, the base triangle section 16 forms an equilateral triangle. The joints 16*a*, 16*b*, and 16*c* of the base triangle section 16 are substantially larger than the joints 14*a*, 14*b*, and 14*c* of the upper triangle section 14. Also, the hoses 26, 28, and 30 of the base triangle section 16 are approximately three times longer than the respective hoses 20, 22, and 24 of the upper triangle section 14. In the preferred embodiment, each side of the equilateral triangle formed by the base triangle section 16 measures approximately 48 inches in length. Thus, the sides of the base triangle section 16 are almost three times longer than the sides of the upper triangle section 14. This approximate three-to-one ratio of the length of the sides of the base triangle section 16 to the length of the sides of the upper triangle section 14 effectively stabilizes the portable shower 10.

In an alternative embodiment, at least one of the hoses 20, 22, and 24 of the upper triangle section 14 has a different length relative to the remaining hoses of the upper triangle section 14. Likewise, at least one of the hoses 26, 28, and 30 of the base triangle section 16 has a different length relative to the remaining hoses of the base triangle section 16. Such differently-sized hoses may be used to create upper and lower triangle sections having one side longer than the remaining two sides. This longer side facilitates entry into the portable shower 10.

Figure 2:
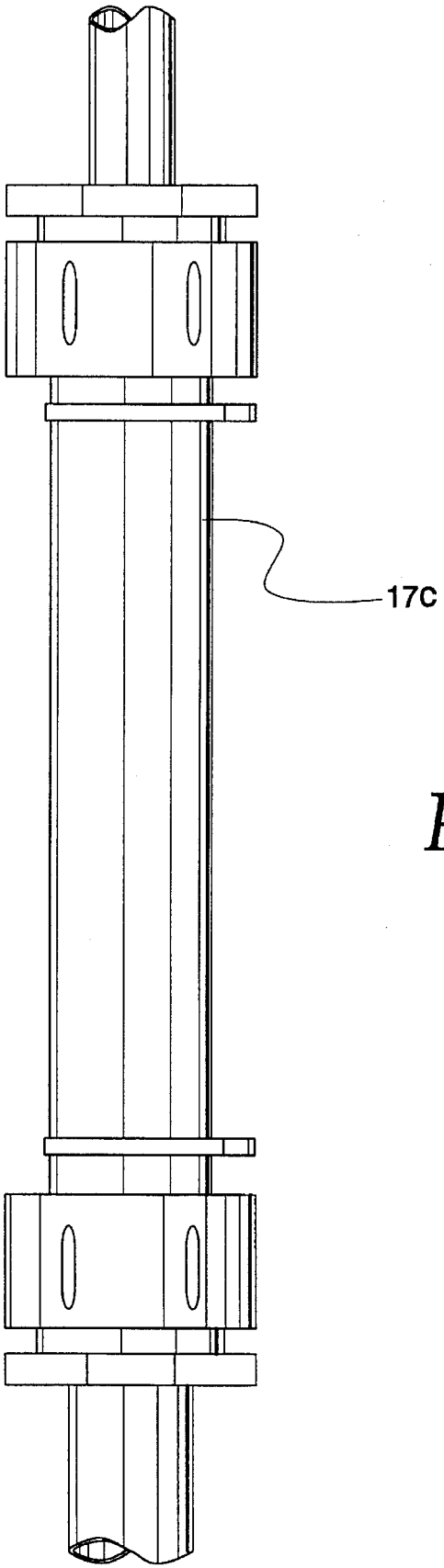
FIG. 2 is an enlarged side view of a flexible hose of a supporting post of the emergency decontamination shower in FIG. 1.

The hollow supporting posts 17, 18, and 19 connect the respective joints 14*a*, 14*b*, and 14*c* of the upper triangle section 14 to the respective joints 16*a*, 16*b*, and 16 of the base triangle section 16. In particular, the supporting post 17 connects the joint 14*a* to the joint 16*a*, the supporting post 18 connects the joint 14*b* to the joint 16*b*, and the supporting post 19 connects the joint 14*c* to the joint 16*c*. Each supporting post is preferably formed from a pair of rigid pipes linked by a flexible hose. More specifically, the supporting post 17 is constructed from a pair of rigid pipes 17*a*, 17*b* joined by a flexible hose 17*c*; the supporting post 18 is constructed from a pair of rigid pipes 18*a*, 18*b* joined by a flexible hose 18*c*; and the supporting post 19 is constructed from a pair of rigid pipes 19*a*, 19*b* joined by a flexible hose 19*c*. FIG. 2 is an enlarged side view of the flexible hose 17*c*.

Figure 5:
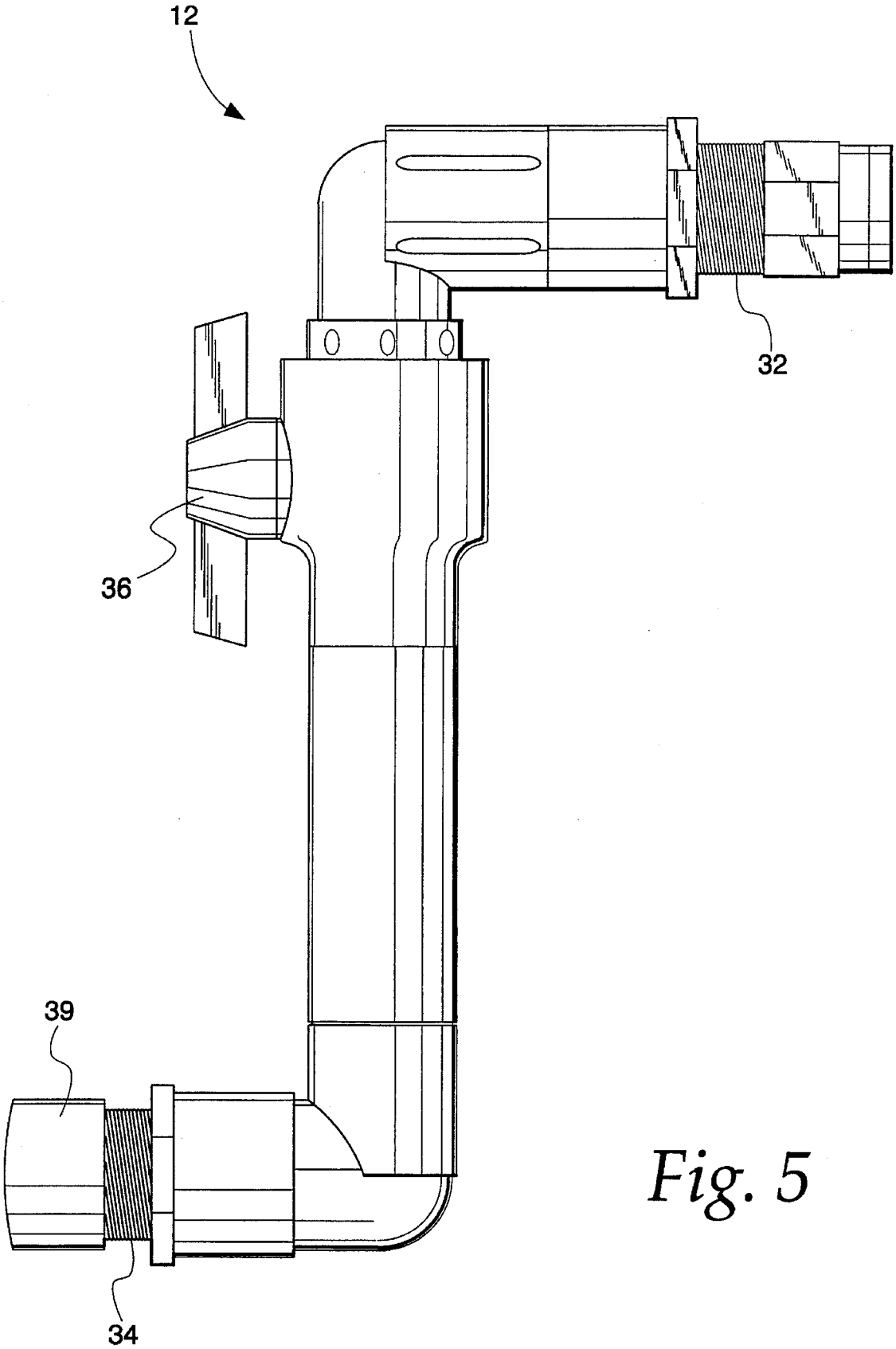
FIG. 5 is an enlarged side view of an inlet manifold of the emergency decontamination shower in FIG. 1.
Figure 6:
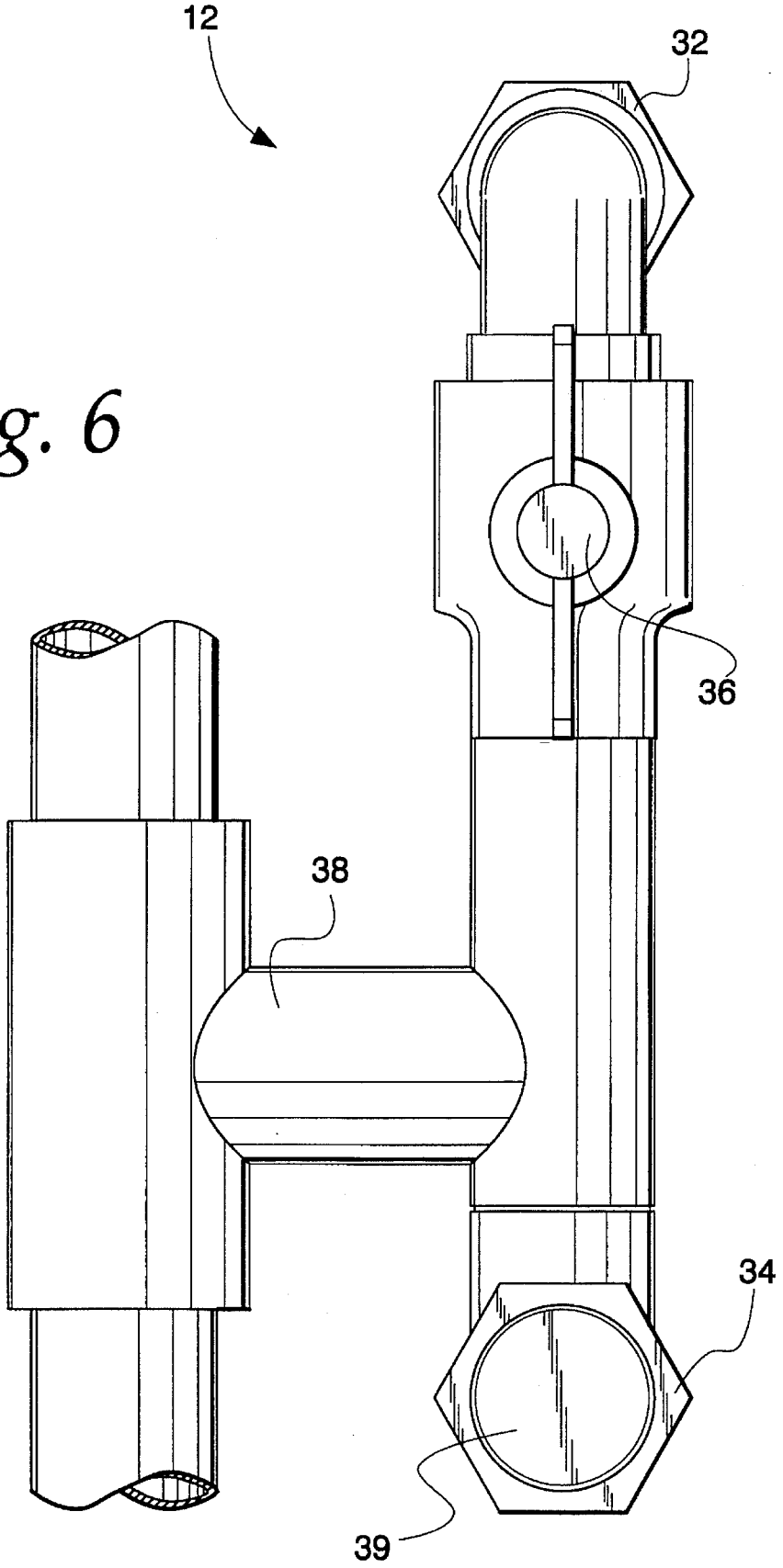
FIG. 6 is another enlarged side view of the inlet manifold of the emergency decontamination shower in FIG. 1.

The inlet manifold 12 includes a primary hose connector 32, a secondary hose connector 34, a stop valve 36, and an output 38. FIGS. 5 and 6 are enlarged side views of the inlet manifold 12. Referring to FIGS. 1, 5, and 6, the output 38 is connected to the lower pipe 19*b* of the supporting post 19. To provide fluid communication between a water supply and the portable shower 10, the primary hose connector 32 is threadably engaged to a standard size hose which, in turn, is connected to a water supply of specified pressure and flow. Also, an emergency responder arranges the portable shower 10 into the compact form illustrated in FIG. 7. As is apparent in FIG. 7, the upper and base triangle sections 14, 16 might not be configured as perfect triangles prior to injecting water into the portable shower 10. When the water supply is turned "on" water from the water supply advances through the standard size hose and into the inlet manifold 12 via the primary hose connector 32.

The valve 36 is positioned adjacent the primary hose connector 32 and is used to regulate the flow of water to both the output 38 and secondary hose connector 34. When the valve 36 is in a closed position, the valve 36 completely interrupts the flow of water. When the valve 36 is in a fully open position, a maximum amount of water flows through the valve 36. If the passageway through the secondary hose connector 34 is sealed with a screw-on cap 39, all the water flowing through the valve 36 exits the inlet manifold 12 via the output 38. Since the output 38 is connected to the lower pipe 19*b* of the supporting post 19, the water enters this lower pipe 19*b*.

Water pressure causes the water entering the lower pipe 19*b* to be distributed throughout the remainder of the supporting post 19, the supporting posts 18, 19, the upper triangle section 14, and the lower triangle section 16. As the water is distributed throughout the portable shower 10, the water pressure causes the portable shower 10 to transform from the compact form in FIG. 7 to the expanded form in FIG. 1. In response to a slight lift of one of the upper posts 17*a*, 18*a*, and 19*a*, the upper triangle section 14 "pops" into the position depicted in FIG. 1 so that the portable shower 10 is ready for use.

As stated above, water flowing into the portable shower 10 causes the shower 10 to transform from the compact form in FIG. 7 to the expanded form in FIG. 1. When the portable shower 10 is in compact form (FIG. 7), the upper pipes 17*a*, 18*a*, and 19*a* of the respective supporting posts 17, 18, and 19 are folded about the respective flexible hoses 17*c*, 18*c*, and 19*c* and positioned at acute angles relative to the respective lower pipes 17*b*, 18*b*, and 19*b*. With the supporting posts 17, 18, and 19 folded in the foregoing manner, the upper triangle section 14 is generally co-planar with the base triangle section 16.

When the portable shower is in expanded form (FIG. 1), the upper pipes 17*a*, 18*a*, and 19*a* of the respective supporting posts 17, 18, and 19 are positioned at obtuse angles relative to the respective lower pipes 17*b*, 18*b*, and 19*b*. Accordingly, the upper triangle section 14 is positioned generally parallel to and relatively far away from the base triangle section 16.

The water distributed throughout the portable shower 10 exits the shower 10 via one or more spray nozzles 40 mounted to the supporting posts 17, 18, and 19. The spray nozzles 40 direct the exiting water inward toward an individual, such as an emergency responder or victim, standing within the base triangle section 16. In the preferred embodiment, a total of seven spray nozzles 40 are mounted to the supporting posts 17, 18, and 19. More specifically, first and second spray nozzles 40 are mounted to the respective upper and lower pipes 17*a*, 17*b* near the hose 17*c*. Similarly, third and fourth spray nozzles 40 are mounted to the respective upper and lower pipes 18*a*, 18*b* near the hose 18*c*. Fifth and sixth spray nozzles 40 are mounted to the respective upper and lower pipes 19*a*, 19*b* near the hose 19*c*. A seventh spray nozzle 40 is mounted to the joint 14*c* at the uppermost end of the supporting post 19.

To assist drenching and decontamination of an emergency responder or victim standing within the shower 10, an optional drench hose may be connected to the secondary hose connector 34. With the drench hose connected to the secondary hose connector 34, some of the water flowing through the valve 36 is diverted away from the output 38 and into the drench hose. An individual holding the drench hose aims the water exiting from the unconnected end of the drench hose at the emergency responder or victim standing within the shower 10. The drench hose, for example, may be used to assist cleansing of more heavily contaminated areas of the emergency responder or victim.

In the preferred embodiment, the joints 14*a–c*, 16*a–c* and the upper and lower pipes 17*a–b*, 18*a–b*, and 19*a–b* of the supporting posts 17, 18, and 19 are composed of a corrosive-resistant, rigid plastic material such as PVC or CPVC. The hoses 20, 22, and 24 of the upper triangle section 14, the hoses 26, 28, and 30 of the lower triangle section 16, and the hoses 17*c*, 18*c*, and 19*c* of the supporting posts are preferably lay-flat collapsible vinyl hose. Alternatively, these hoses may be composed of rubber or cloth. The various hoses, pipes, and joints of the portable shower 10 are connected to one another using conventional insert fittings such as adhesive fittings or screw fittings. The spray nozzles 40 are preferably full-cone wide-angle spray nozzles 40.

The unique design of the portable shower 10 provides quick deployment; the shower 10 is fully erect and operational within ten seconds of turning on the water. The shower 10 stands approximately eight feet tall in the expanded form shown in FIG. 1, and the seven spray nozzles 40 are positioned to provide complete drenching of an emergency responder or victim standing within the shower 10. The shower 10 is sized to accommodate an emergency responder in full chemical gear with self-contained breathing apparatus. The shower 10 is designed to provide an approximate five gallon per minute flow rate at 40 PSI inlet water operating pressure. At this flow rate, the shower 10 provides users with a thorough drenching and decontamination. Although water sources typically provide water at a pressure between approximately 40 and 60 pounds per square inch (PSI), the shower 10 may be utilized with a water source having a water pressure as low as about 20 PSI.

The portable shower 10 is preferably constructed so that, in storage, the upper and base triangle sections 14, 16 collapse together and the supporting posts 17, 18, and 19 fold over on themselves about the hoses 17*c*, 18*c*, and 19*c*. Therefore, the portable shower 10 can be stored in a relatively small space (e.g., less than five cubic feet) compared to the size of the shower 10 when in operation.

The use of the portable shower 10 is not limited to chemical decontamination and emergency response areas. The portable shower 10 can provide safe, effective response for a variety of other locations, including loading docks, agricultural locations, construction sites, and recreational areas. For example, the portable shower 10 may be used at the beach to rinse off sand.

While the present invention has been described with reference to one or more particular embodiments, those skilled in the art will recognize that many changes may be made thereto without departing from the spirit and scope of the present invention.

For example, each of the supporting posts 17, 18, and 19 may be formed with a single rigid pipe, instead of a pair of rigid pipes and a flexible connecting hose. Thus, the upper and lower rigid pipes 17*a*, 17*b* and the hose 17*c* may be replaced with a single rigid pipe. Similarly, the upper and lower rigid pipes 18*a*, 18*b* and the hose 18*c* may be replaced with a single rigid pipe, and the upper and lower rigid pipes 19*a*, 19*b* and the hose 19*c* may be replaced with a single rigid pipe. Alternatively, each of the supporting posts 17, 18, and 19 may be formed with more than two rigid pipes and, accordingly, more than one connecting hose. For example, each supporting post may be formed with three rigid pipes joined by two flexible hoses.

Furthermore, the upper and base sections 14, 16 may be configured as rectangles, pentagons, hexagons, or other polygons. If, for example, the upper and base sections 14, 16 are configured as rectangles, the upper and base sections would each include four flexible hoses connected by four joints.

Each of these embodiments and obvious variations thereof is contemplated as falling within the spirit and scope of the claimed invention, which is set forth in the following claims.

What is claimed is:

1. A portable shower, comprising:

a fluid-conveying structure including a base polygon section including a first plurality of flexible hoses connected by a first set of rigid hollow joints;

an upper polygon section including a second plurality of flexible hoses connected by a second set of rigid hollow joints; and a plurality of hollow supporting posts connecting said first set of joints to said second set of joints, each of said supporting posts including at least one rigid pipe;

a spray nozzle mounted to said fluid-conveying structure; and an entryway connected to said fluid-conveying structure and constructed and arranged for connection to a water source.

2. The portable shower of claim 1, wherein said entryway includes an inlet manifold having a primary hose connector and an output, said output being connected to said fluid-conveying structure, said primary hose connector being constructed and arranged for connection to a primary hose.

3. The portable shower of claim 2, wherein said output of said inlet manifold is connected to one of said supporting posts.

4. The portable shower of claim 2, wherein said inlet manifold includes a secondary hose connector constructed and arranged for connection to a secondary hose.

5. The portable shower of claim 2, wherein said inlet manifold includes a valve positioned between said primary hose connector and said output to regulate the flow of water to said output.

6. The portable shower of claim 1, wherein said first set of joints, said second set of joints, and said rigid pipe of each of said supporting posts are composed of plastic.

7. The portable shower of claim 1, wherein said first plurality of hoses and said second plurality of hoses are lay-flat collapsible vinyl hoses.

8. The portable shower of claim 1, wherein said spray nozzle is a full-cone wide-angle spray nozzle.

9. The portable shower of claim 1, wherein each of said supporting posts includes a pair of rigid pipes linked by a flexible hose, one of said pair of rigid pipes being connected to one of said first set of joints, the other of said pair of rigid pipes being connected to one of said second set of joints.

10. The portable shower of claim 1, wherein said first plurality of hoses includes three hoses and said first set of joints includes three joints such that said base polygon section is configured as a triangle, and wherein said second plurality of hoses includes three hoses and said second set of joints includes three joints such that said upper polygon section is configured as a triangle, and wherein said plurality of supporting posts includes three supporting posts.

11. A portable shower, comprising:

a fluid-conveying structure including a base triangle section including a first set of three flexible hoses connected by a first set of three rigid hollow joints;

an upper triangle section including a second set of three flexible hoses connected by a second set of three rigid hollow joints; and three hollow supporting posts connecting said first set of joints to said second set of joints, each of said supporting posts including a pair of rigid pipes linked by a flexible hose, one of said pair of rigid pipes being connected to one of said first set of joints, the other of said pair of rigid pipes being connected to one of said second set of joints, a plurality of spray nozzles mounted to said fluid-conveying structure; and an inlet manifold connected to said fluid-conveying structure and constructed and arranged for connection to a water source.

12. The portable shower of claim 11, wherein said inlet manifold includes a primary hose connector and an output, said output being connected to one of said supporting posts, said primary hose connector being constructed and arranged for connection to a primary hose.

13. The portable shower of claim 11, wherein said plurality of spray nozzles includes a pair of spray nozzles mounted to said respective pair of rigid pipes of each of said supporting posts.

14. The portable shower of claim 13, wherein said plurality of spray nozzles includes another spray nozzle mounted to one of said second set of joints.

15. The portable shower of claim 11, wherein said inlet manifold includes a primary branch, a secondary branch, and an output branch coupled to both said primary branch and secondary branch, said output branch being connected to said fluid-conveying structure, said primary branch including a primary hose connector constructed and arranged for connection to a primary hose, said secondary branch including a secondary hose connector constructed and arranged for connection to a secondary hose.

16. The portable shower of claim 15, wherein said primary branch includes a valve to regulate the flow of water to said output and said secondary branch.

17. A portable shower transformable between a compact form and an expanded form, said portable shower comprising:

a fluid-conveying structure including a base polygon section including a first plurality of flexible hoses connected by a first set of rigid hollow joints;

an upper polygon section including a second plurality of flexible hoses connected by a second set of rigid hollow joints; and a plurality of hollow supporting posts connecting said first set of joints to said second set of joints, each of said supporting posts including upper and lower rigid pipes linked by a flexible hose;

a spray nozzle mounted to said fluid-conveying structure; and an entryway connected to said fluid-conveying structure and constructed and arranged for connection to a water source;

wherein when the portable shower is in compact form, said upper pipe of each of said supporting posts is folded about said flexible hose and positioned at an acute angle relative to said lower pipe, and said upper triangle section is in close proximity to said base triangle section; and wherein when the portable shower is in expanded form, said upper pipe of each of said supporting posts is positioned at an obtuse angle relative to said lower pipe, and said upper triangle section is positioned relatively far away from said base triangle section;

the portable shower being transformed from the compact form to the expanded form in response to water flowing into said fluid-conveying structure via said entryway.

18. The portable shower of claim 17, wherein said upper triangle section is generally co-planar with said base triangle section when the portable shower is in compact form.

* * * * *